US008070521B2

(12) United States Patent
Li

(10) Patent No.: US 8,070,521 B2
(45) Date of Patent: Dec. 6, 2011

(54) SOCKET CONNECTOR AND ELECTRONIC DEVICE USING THE SAME

(75) Inventor: Jian-Hui Li, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 12/823,221

(22) Filed: Jun. 25, 2010

(65) Prior Publication Data

US 2011/0189869 A1 Aug. 4, 2011

(30) Foreign Application Priority Data

Feb. 4, 2010 (CN) ..... 2010 1 0301232

(51) Int. Cl.
*H01R 24/00* (2011.01)

(52) U.S. Cl. ..... 439/631

(58) Field of Classification Search ..... 439/630, 439/631, 634
See application file for complete search history.

(56) References Cited

U.S. PATENT DOCUMENTS

| | | | | |
|---|---|---|---|---|
| 7,131,871 | B1 * | 11/2006 | Zuo et al. | 439/630 |
| 7,377,816 | B1 * | 5/2008 | Lin | 439/630 |
| 7,530,852 | B2 * | 5/2009 | Hu et al. | 439/630 |
| 7,568,953 | B1 * | 8/2009 | Ho et al. | 439/630 |

* cited by examiner

*Primary Examiner* — Ross Gushi
(74) *Attorney, Agent, or Firm* — Altis Law Group, Inc.

(57) ABSTRACT

A socket connector is configured for receiving a first card and a second card. The socket connector includes a latching seat, a plurality of latching plates, and a shielded case. The latching seat includes a first surface and an opposite second surface, the first surface defines a sliding groove, a second surface defines a receiving slot. The latching plates extend from edges of the first surface. The shielded case is secured in the receiving slot, and defines an entrance. The first card is received in the sliding groove and latched by the latching plates, the second card is inserted into the shielded case through the entrance. The disclosure further discloses an electronic device using the socket connector.

12 Claims, 5 Drawing Sheets

SOCKET CONNECTOR AND ELECTRONIC DEVICE USING THE SAME

BACKGROUND

1. Technical Field

The present disclosure generally relates to socket connectors, and particularly, to a socket connector for use in an electronic device.

2. Description of Related Art

Generally, an electronic device has a subscriber identity module (SIM) card used for authorizing personal information and credit payment, and a SD secure digital memory (SD) card used for storing data for variety of contents. The SIM card is generally installed on a bottom of a battery chamber, which a battery abuts to reduce the risk of loss of the SIM card. The SD card is generally installed on a side surface of the electronic device so that it can be easily replaced.

However, since a first connector for fixing and connecting the SIM card and a second connector for fixing and connecting the SD card are individually mounted and installed in different respective locations, different spaces for mounting the first connector and the second connector are required. This makes it difficult to reduce the thickness and size of the electronic device.

Therefore, there is room for improvement within the art.

BRIEF DESCRIPTION OF THE DRAWINGS

Many aspects of the socket connector and electronic device using the same can be better understood with reference to the following drawings. The components in the drawings are not necessarily to scale, the emphasis instead being placed upon clearly illustrating the socket connector and electronic device using the same. Moreover, in the drawings, like reference numerals designate corresponding parts throughout the several views.

DETAILED DESCRIPTION

Figure 1:
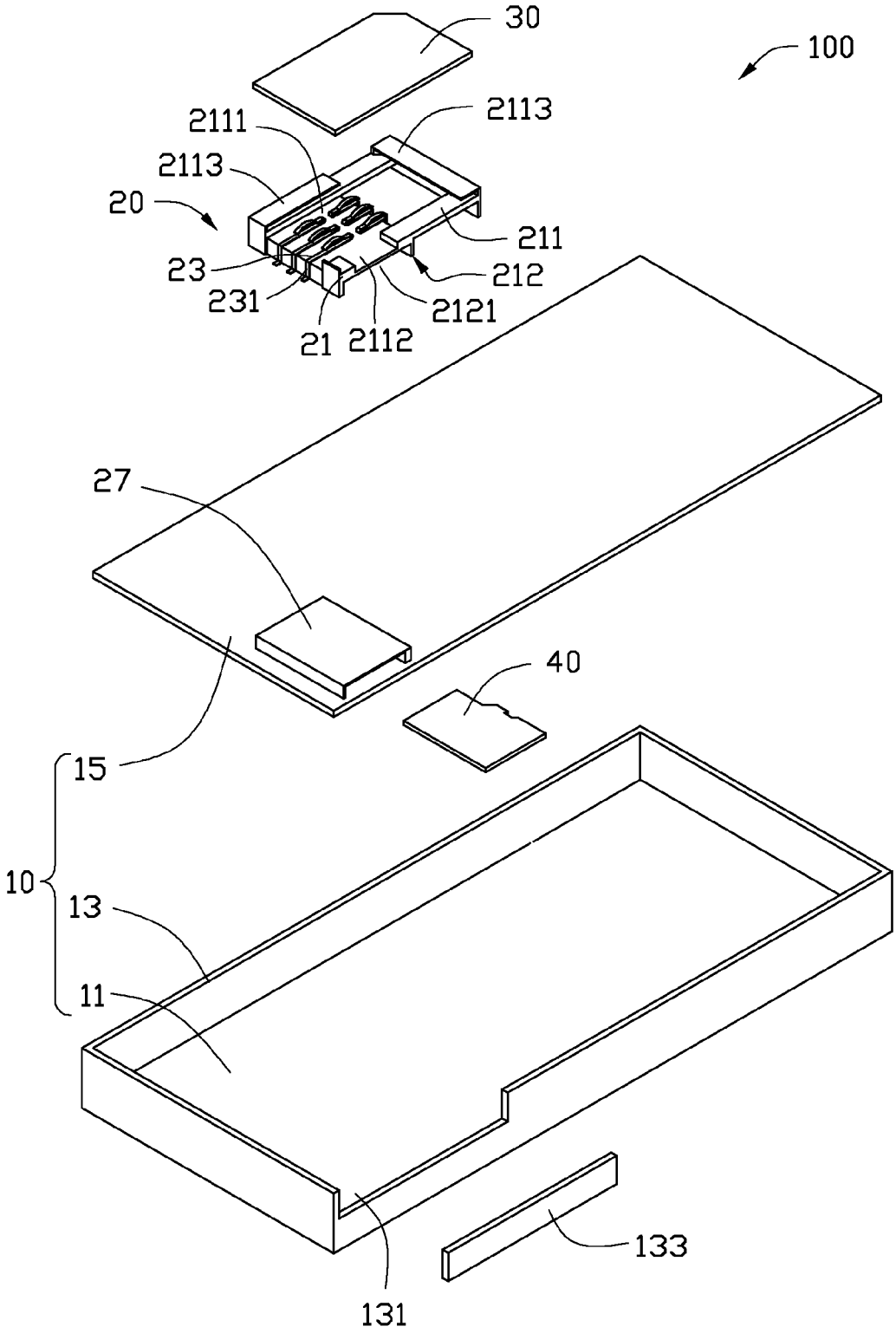
FIG. 1 is an exploded, isometric view of an exemplary electronic device.

FIG. 1 shows an exemplary embodiment of an electronic device 100, such as mobile phones, or personal digital assistants. The electronic device 100 includes a main body 10, a printed circuit board 15, a socket connector 20, a first card 30, and a second card 40. The socket connector 20 is assembled in the main housing 10. The first card 30 and the second card 40 are received together in the socket connector 20 to electronically connect to the electronic device 100.

The main body 10 includes a bottom wall 11 and a peripheral wall 13. The peripheral wall 13 is substantially perpendicularly arranged at the peripheral edge of the bottom wall 11. The peripheral wall 13 defines an opening 131. A cover 133 is detachably assembled in the opening 131 to prevent external elements from entering the electronic device 100. The printed circuit board 15 is assembled in the main body 10.

Figure 2:
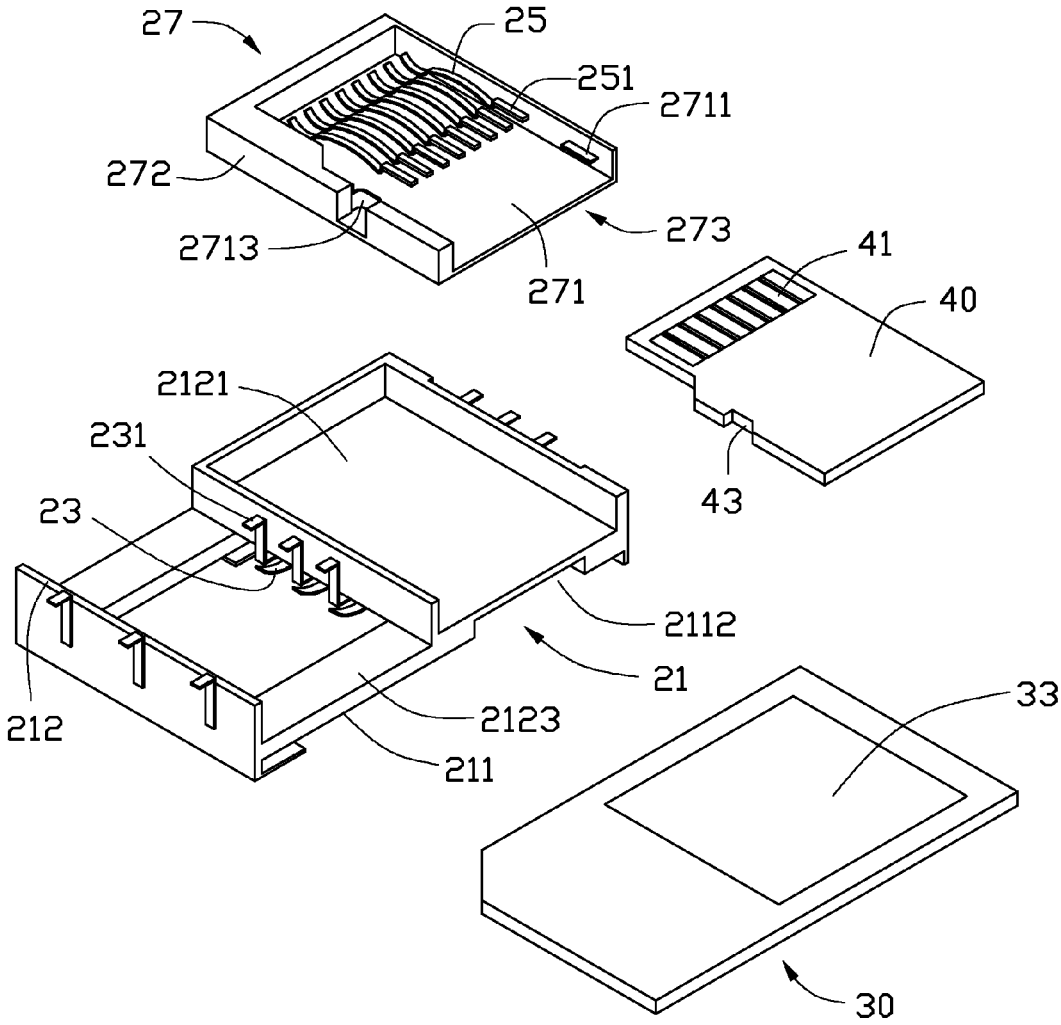
FIG. 2 is an enlarged, exploded view of a socket connector shown in FIG. 1, but viewed from another angle.

Referring to FIG. 2, the socket connector 20 includes a latching seat 21, a plurality of first terminals 23, a plurality of second terminals 25, and a shielded case 27. Both of the first terminals 23, the second terminals 25, and the shielded case 27 are assembled to the latching seat 21.

The latching seat 21 may be made of an insulating material, and includes a first surface 211 and an opposite second surface 212. The first surface 211 defines a sliding groove 2111, a lateral slot 2112, and a plurality of holding plates 2113 positioned thereon. The second surface 212 defines a receiving slot 2121 and a through slot 2123.

The sliding groove 2111 is configured for receiving the first terminals 23 and the first card 30. The lateral slot 2112 is defined in a sidewall of the latching seat 21, and communicates with the sliding groove 2111. The lateral slot 2112 is configured for conveniently taking from or placing the second card 40 into the sliding groove 2111. Each holding plate 2113 substantially perpendicularly extends from edges of the first surface 211, and is bent into a substantial L-shaped. Thus, a distal end of each holding plate 2113 is substantially parallel to the first surface 211 for latching the first card 30.

The receiving slot 2121 is configured for receiving the shielded case 27. The through slot 2123 is defined in the second surface 212 adjacent to the receiving slot 2121, and communicates with the sliding groove 2111.

The first terminals 23 are arranged in the sliding groove 2111, and a free end 231 of each first terminal 23 can be electronically connected to the printed circuit board 15. The second terminals 25 are arranged in the shielded case 27, and a free end 251 of each second terminal 25 can be electronically connected to the printed circuit board 15.

The shielded case 27 is made of metal, and includes a bottom plate 271 and three sidewalls 272 substantially perpendicularly extending from three edges of the bottom plate 271. Thus, an entrance 273 is defined at a side of the shielded case 27. Two protrusions 2711 are extended from two opposite sidewalls 272 opposite to each other, and are configured for guiding the second card 40 to slide into the shielded case 27. A positioning member 2713 extends from one sidewall 272 aligning with one of the protrusions 2711. The positioning member 2713 can be made of resilient material for latching the second card 40.

The first card 30 may be a SIM card, and includes a first contact 33 disposed thereon for electronically connecting the first terminals 23. The second card 40 may be a SD card, and includes a plurality of second contacts 41 for electronically connecting the second terminals 25. A sidewall of the second card 40 defines a notch 43 for engagement with the positioning member 2713.

Figure 3:
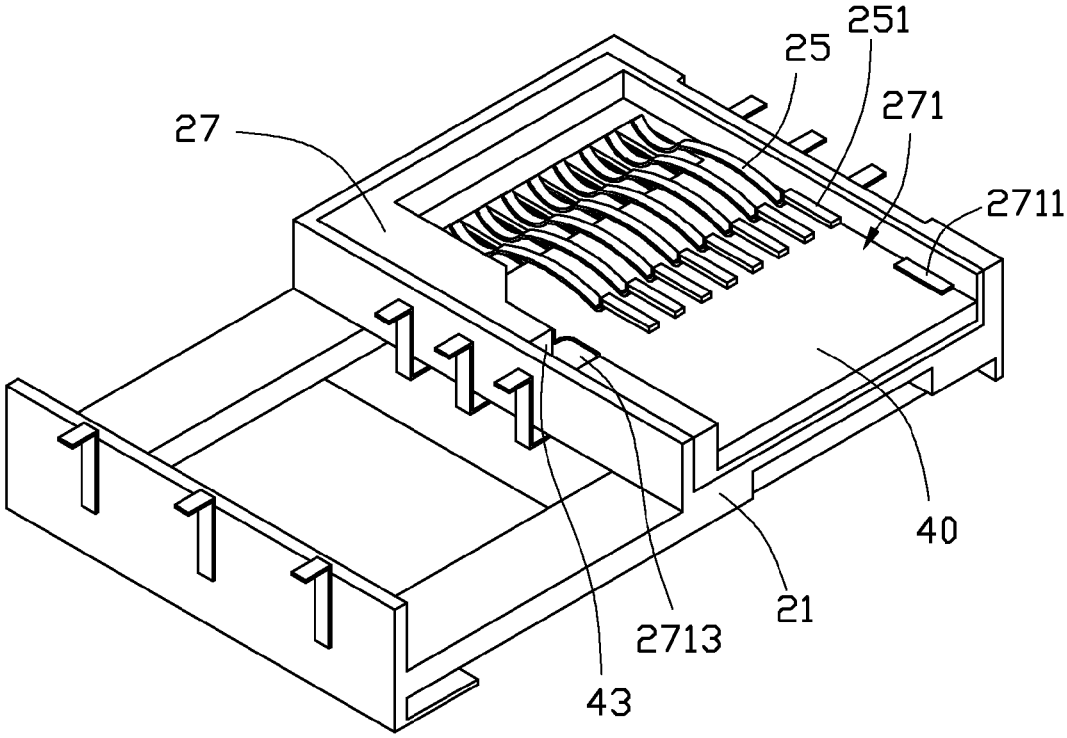
FIG. 3 is an assembled, isometric view of the socket connector shown in FIG. 2.
Figure 4:
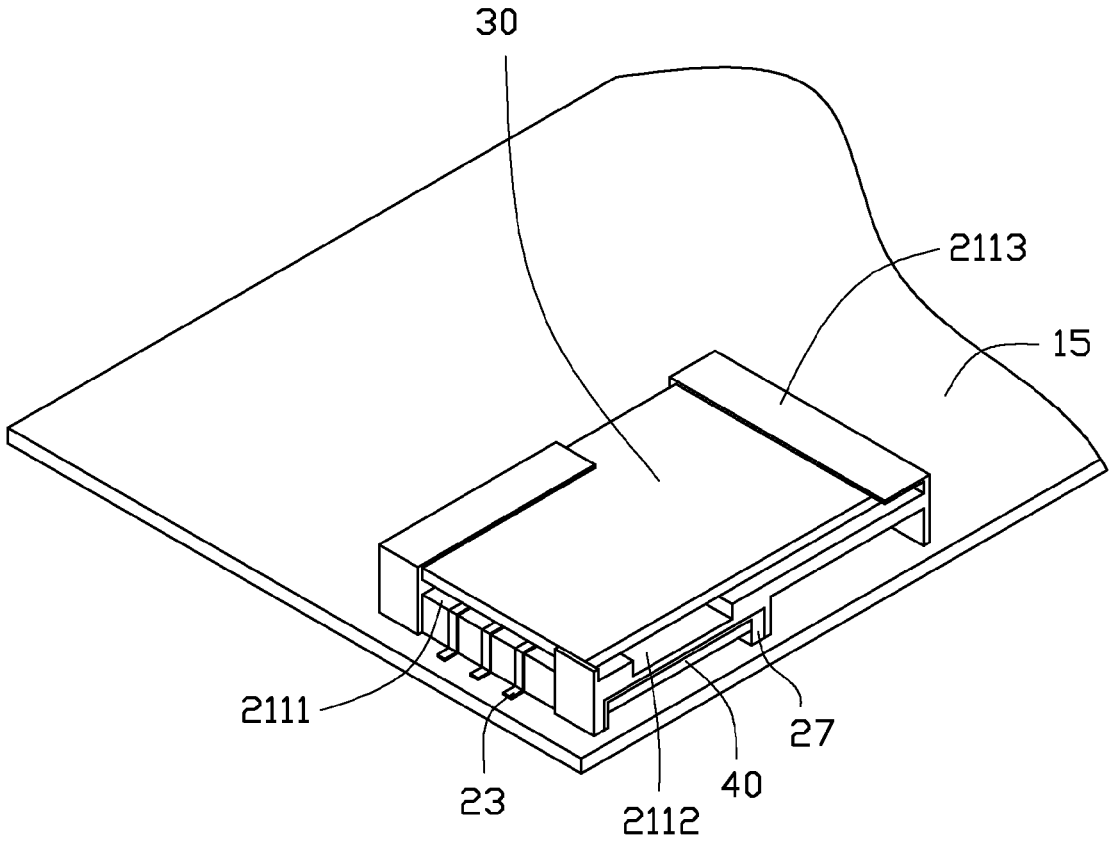
FIG. 4 is an assembled, isometric view of the socket connector disposed on a printed circuit board.
Figure 5:
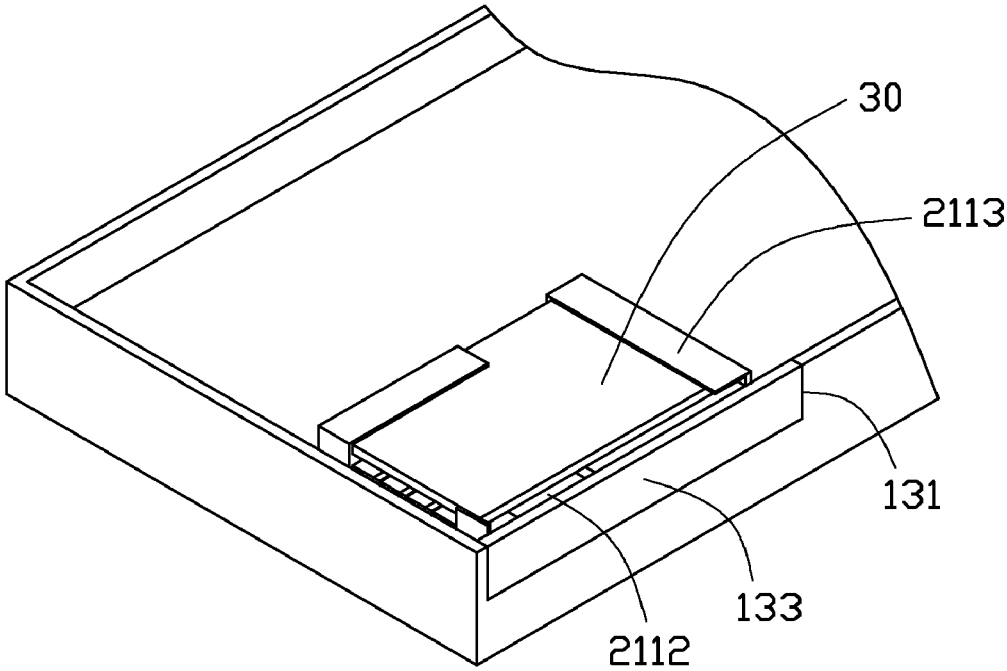
FIG. 5 is a partially, assembled view of the electronic device shown in FIG. 1.

Referring FIGS. 3 to 5, when the socket connector 20 is to be assembled to the electronic device 100. The shielded case 27 is received in the receiving slot 2121, the free end 251 of each second terminal 25 electronically connects the printed circuit board 15, and the free end 231 of each first terminal 23 electronically connects the printed circuit board 15. The latching seat 21 is fixed on the printed circuit board 15, the lateral slot 2112 and the entrance 273 aligns with the opening 131. Thus, the socket connector 20 is electronically connected to the printed circuit board 15.

When the first card 30 and the second card 40 are to be installed in the electronic device 100, the cover 133 is detached from the electronic device 100 and the socket connector 20 is exposed from the opening 131. The first card 30 is inserted into the sliding groove 2111 and is held in place by the holding plates 2113. The first terminals 23 are electronically connected to the first contact 33. The second card 40 is inserted into the entrance 273 by the protrusions 2711. The second terminals 25 electronically connect to the second contacts 41. The positioning member 2713 engages with the notch 43 and the cover 133 is received in the opening 131. Thus, the first card 30 and the second card 40 are installed in the electronic device 100.

It is to be understood, however, that even through numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A socket connector for receiving a first card and a second card, the socket connector comprising:

a latching seat comprising a first surface and an opposite second surface, the first surface defining a sliding groove, the second surface defining a receiving slot;

a plurality of holding plates extending from edges of the first surface; and a shielded case made of metal, secured in the receiving slot, and defining an entrance, the shielded case including a bottom plate and three sidewalls perpendicularly extending from three edges of the bottom plate, two protrusions extending from two opposite sidewalls facing each other;

wherein the first card is received in the sliding groove and held in place by the holding plates, the second card is inserted into the shielded case through the entrance.

2. The socket connector as claimed in claim 1, wherein the latching seat further defines a lateral slot communicating with the sliding groove, each holding plate perpendicularly extends from edges of the first surface, and is bent into L shape, a distal end of each holding plate is parallel to the first surface.

3. The socket connector as claimed in claim 2, further comprising a plurality of first terminals and second terminals; the first terminals are disposed on a bottom of the sliding groove, the second terminals are disposed on a bottom of the shielded case.

4. The socket connector as claimed in claim 1, wherein the shielded case further comprises a positioning member extending from one sidewall facing one of the protrusions.

5. The socket connector as claimed in claim 1, wherein the second surface further defines a through slot adjacent to the receiving slot, and communicates with the sliding groove.

6. An electronic device, comprising:

a main body;

a printed circuit board received in the main body;

a socket connector disposed on the printed circuit board, and for receiving a first card and a second card; the socket connector comprising a latching seat and a shielded case made of metal, the shielded case including a bottom plate and three sidewalls perpendicularly extending from three edges of the bottom plate, two protrusions extending from two opposite sidewalls facing each other;

wherein the latching seat includes a plurality of holding plates extending from edges thereof, and defining a sliding groove and a receiving slot; the shielded case is secured in the receiving slot, and defines an entrance; the first card is received in the sliding groove and held in place by the holding plates, the second card is inserted into the shielded case through the entrance.

7. The electronic device as claimed in claim 6, wherein the main body comprises bottom wall, a peripheral wall perpendicularly disposed at peripheral edge of the bottom wall, the peripheral wall defines an opening, a cover is detachably assembled in the opening.

8. The electronic device as claimed in claim 7, wherein the latching seat further defines a lateral slot communicating with the sliding groove, the lateral slot aligns with the opening.

9. The electronic device as claimed in claim 6, wherein the each holding plate perpendicularly extends from edges of the latching seat, and is bent into L shape, a distal end of each holding plate is parallel to the latching seat.

10. The electronic device as claimed in claim 6, wherein further comprising a plurality of first terminals and second terminals electronically connected to the printed circuit board; the first terminals are disposed on a bottom of the sliding groove, the second terminals are disposed on a bottom of the shielded case.

11. The electronic device as claimed in claim 6, wherein the shielded case further comprises a positioning member extending from one sidewall facing one of the protrusions.

12. The electronic device as claimed in claim 6, wherein the latching seat further defines a through slot adjacent to the receiving slot, and communicates with the sliding groove.

* * * * *